United States Patent [19]

Weider

[11] 4,121,827

[45] Oct. 24, 1978

[54] ELASTIC TYPE EXERCISING DEVICE

[76] Inventor: Benjamin D. Weider, 165 Finchley Rd., Hampstead, P.Q., Canada

[21] Appl. No.: 785,171

[22] Filed: Apr. 6, 1977

[51] Int. Cl.[2] ..... A63B 21/02

[52] U.S. Cl. ..... 272/137; 272/143; 272/142

[58] Field of Search ..... 272/137, 142, 143, 135, 272/136, 116

[56] References Cited

U.S. PATENT DOCUMENTS

| | | | |
|---|---|---|---|
| 562,389 | 6/1896 | Gossweiler | 272/136 |
| 605,237 | 6/1898 | Spink | 272/136 |
| 3,531,113 | 9/1970 | Sherman et al. | 272/137 X |
| 3,838,852 | 10/1974 | Gury | 272/137 |
| 4,033,580 | 7/1977 | Paris | 272/137 |

*Primary Examiner*—William R. Browne

*Attorney, Agent, or Firm*—Stevens, Davis, Miller & Mosher

[57] ABSTRACT

A stretchable exercising device is integrally molded from elastic material and has two separate strap sections each with a handle loop. The strap sections being connected to only one other strap section at a generally central, integral joinder which forms a single continuous uninterrupted unitary connection. The other strap section has a greater resistance to stretching than any of the remaining two, due to an increased cross-sectional area. The loop of the other strap section is large enough to receive two feet in a side-by-side disposition. The remaining two strap sections may also be of mutually different resistance to the stretching force.

6 Claims, 18 Drawing Figures

ELASTIC TYPE EXERCISING DEVICE

The present invention relates to an exerciser of stretchable type, provided with handle means at the ends thereof. In general, this type of exercising devices is engaged, usually by hands but also by feet and by hands of the exercising person who attempts to repeatedly stretch the exerciser against its resilient force.

Two general types of the above type of exerciser are known from prior art. U.S. Pat. No. 1,945,134 issued Jan. 30, 1934 to Brunk discloses an exercising device of the above type which comprises a strap of elastic material transversely disposed hand holes formed integral with the ends of the strap for an easy engagement by the exercising person's hands.

The second known e.g. from U.S. Pat. No. 3,427,023 issued on Feb. 11, 1969 to Silberman. This exerciser comprises two members selectively securable to a predetermined number of resilient ropes or tension springs. Depending on the number of springs or resilient ropes secured to the handles, a greater or lesser force is required for the exercise.

The need of frequent exercise has recently become accepted by an ever increasing segment of population. Exercising devices, in general, are often intended to encourage frequent exercises. If this objective is to be met, a typical exercising device must possess two basic features: it must be as inextensive as possible and, on the other hand, it must be suitable for as a broad segment of general public as possible. Transforming the above objectives to the art of exercises to which the present invention pertains, it will be observed that the exerciser of Brunk, while clearly meeting the objective of a low manufacturing cost (the exerciser being an integrally molded rubber or elastic product), it may only be suitable for a relatively small segment of general public as the force required for stretching the exerciser to a predetermined stretched length is always the same. If the force is too low, those with well developed muscles would not be interested in the exerciser. On the other hand, if the required stretching force is too high, this would discourage many beginners from using same.

On the other hand, the exerciser of the type disclosed in Silberman provides a reasonable variety of degree of the stretching force, depending on the number of the elastic ropes or tension springs attached to the respective handles. However, the overall cost of Silberman exerciser is relatively high thus rendering the exerciser unaffordable to lower income segment of general public.

It is an object of the present invention to provide an exerciser of stretchable type as referred to above, which would combine the advantages of the simplicity of the Brunk exerciser with the selective adjustability of the stretching force during the exercise, as obtainable in Silberman or similar devices.

According to the present invention, an exerciser is provided of the type of an integral product molded from a stretchable material such as suitable grade of rubber. The exerciser comprises an elongated strap portion made of said stretchable material, and handle means, also made from said stretchable material and being integrally molded with end sections of the strap portion. The invention provides a strap portion which comprises a first elongated strap section and a second elongated strap section, said first and second elongated strap sections being of the same length and being integral, at one end thereof with a centrally located joinder section such that said first strap section and said second strap section are normally disposed at an acute angle relative to each other. A first handle loop are integral with the other ends of said first and second strap sections, respectively. The first and said second handle loops are of a generally identical shape and size. A unitary third elongated strap section protrudes from the joinder section and is integral with same. The third strap section is disposed such that it normally forms the leg of a Y-shaped configuration whose arms are defined by said first and second strap sections. A third handle loop integral with the end of said third strap section remote from said joinder section is about twice the size of any of said first and second handle loops, the size of the third loop being in the range sufficient to accomodate within the said third loop to human feet of an average size in a side-by-side disposition.

Preferably, the cross-sectional area of said third strap section is greater than that of any of said first and second strap sections.

According to another embodiment of the present invention, the size of the cross-sectional area of said first strap section is different from that of said second strap section such that each of the strap sections have a different degree of resistance to a stretching force.

According to a further feature of the present invention, the cross-sectional area of the third strap section is generally equal to the sum of cross-sectional area of said first strap section and of the cross-sectional area of the second strap section.

Those skilled in the art will readily appreciate that a great variety of exercising devices according to the present invention can be produced. Two such embodiments will now be described with reference to the accompanying drawings.

Figures 1, 2, 5, 6, 7, 8, 9:
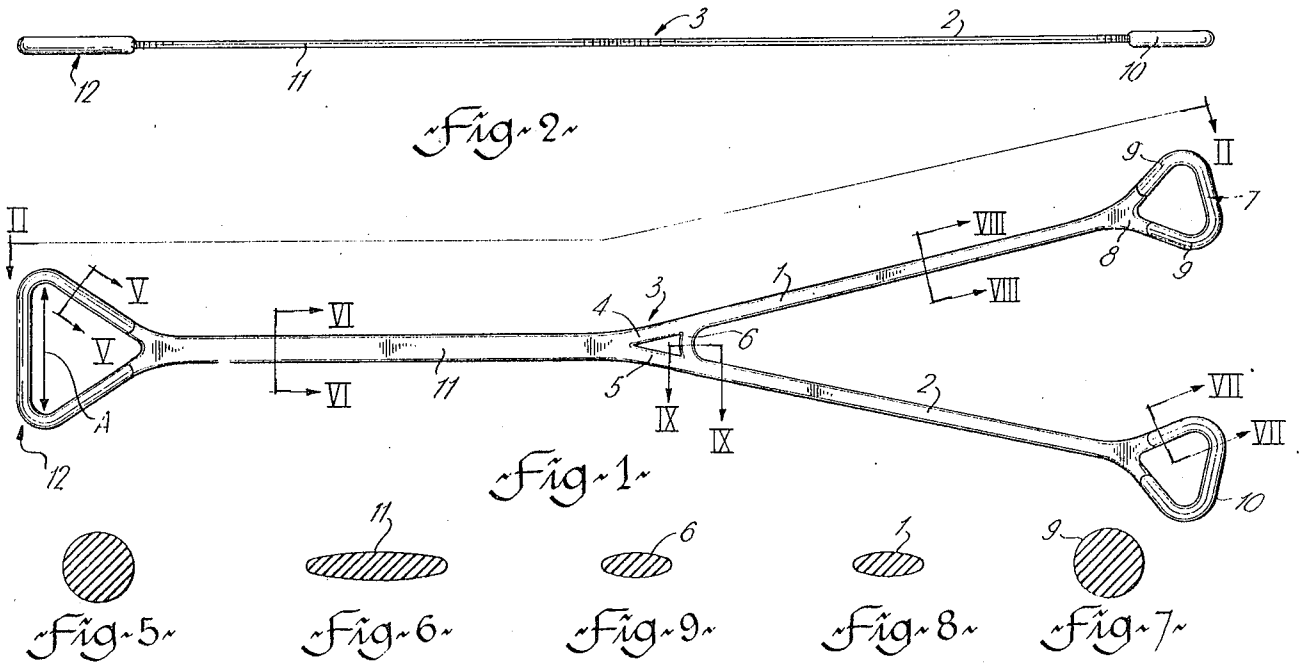
FIG. 1 is a plan of an exercising device according to the present invention showing the exerciser resting on a surface and being in what is referred to as a "normal" state.
FIG. 2 is a side view of the exerciser as shown in FIG. 1.
FIGS. 5–9 (on the sheet of FIG. 1) are sections V—V through IX—IX of FIG. 1 respectively.
Figures 3, 4, 10, 11, 12, 13, 14:
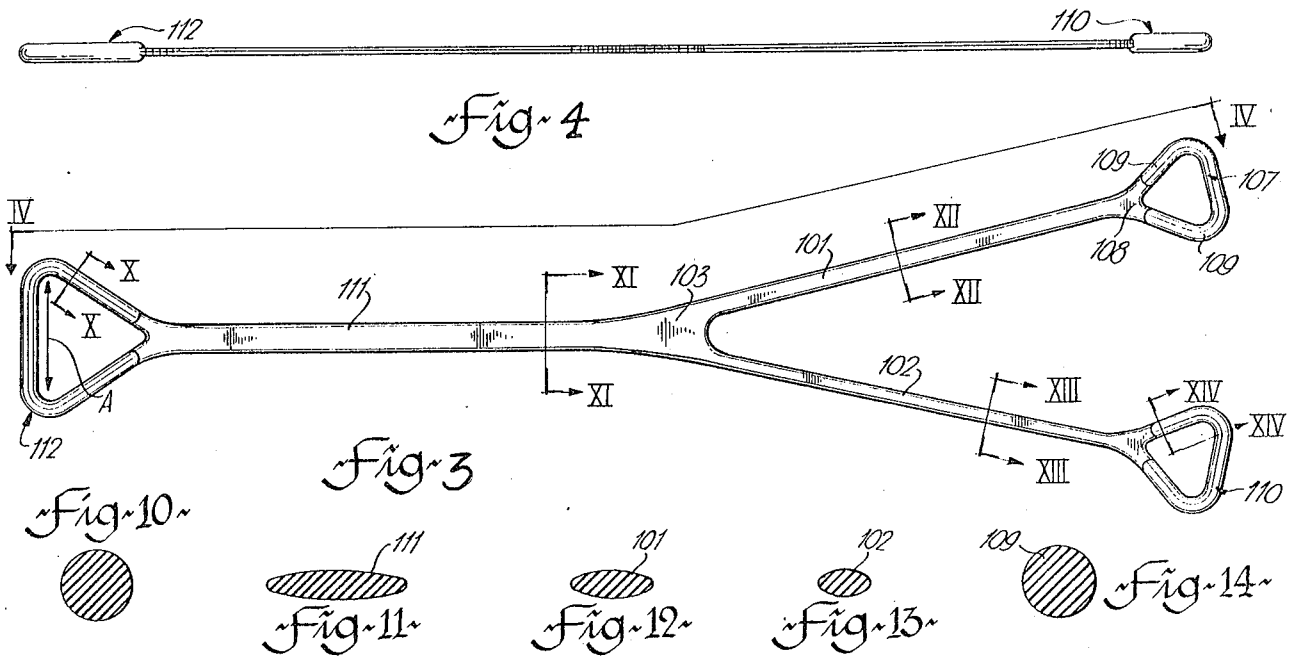
FIG. 3 is a plan view similar to that of FIG. 1 but showing a second embodiment of the exerciser.
FIG. 4 is a side view IV—IV of FIG. 3.
FIGS. 10 through 14 are sections X—X through XIV—XIV of FIG. 3 respectively.
Figure 15:
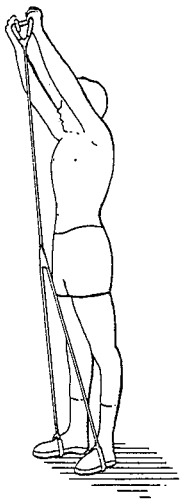
FIG. 15 through FIG. 18 are sketches showing several examples of the exerciser according to the present invention in use.
Figure 17:
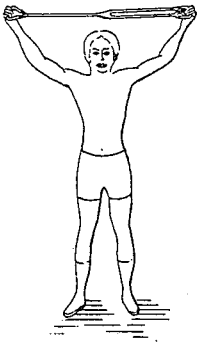

Turning now to the embodiment shown in FIG. 1, the exerciser shown therein is made of an elastic rubber material. Those skilled in the art will appreciate that numerous grades of rubber can be used in producing this kind of exerciser to achieve a suitable combination of elasticity and strength, combined with the properties facilitating the molding operation. The whole product as shown in FIG. 1 or in FIG. 3 is an integral product molded from the above elastic material.

The exerciser includes a first elongated strap section 1 and a second elongated strap section 2. In cross-section, both strap sections 1 and 2 have the shape shown in FIG. 8. The strap sections 1 and 2 merge at a joinder section 3 which in the embodiment of FIG. 1, is a generally triangular configuration comprising two arms 4, 5 and a base 6, the arms 4 and 5 and base 6 being of generally the same cross-section as that of strap sections 1 and 2, as best seen from FIG. 9. The base section 6 is rounded, as seen from FIG. 1. As mentioned above, the whole exerciser is an integrally molded product. Accordingly, the first strap section 1 and the second strap section 2 are integral with the generally centrally located joinder section 3 as referred to herein above. In a normal condition when the exerciser is spread on a flat surface with no tension applied to any part thereof, the first strap section 1 and the second strap section 2 are disposed at an acute angle relative to each other.

The end of the first strap section 1 remote from the joinder section 3 is integral with a first handle loop 7 whose portion 8 is of a generally oval cross-section similar to that of the first strap section 1, while the remaining portion 9 is of a circular cross-section (see FIG. 7).

The second strap section is provided with the same kind of a handle loop 10 integral with the respective end of the strap section 2. The configuration and size of the loops 7 and 10 is identical; therefore, section VII—VII of loop 10 applies to loop 7 as well.

A unitary, third strap section 11 protrudes from the joinder section 3. Again, the strap section 11 is integral with the joinder section 3. As best seen in FIG. 1, the third strap section is normally disposed such that it forms the leg section of a Y-shaped configuration defined by the strap sections 11, 1 and 2, the first and second strap sections 1 and 2 defining the upwardly spreading arm portion of the "Y".

Figure 16:
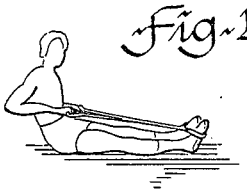
Figure 18:
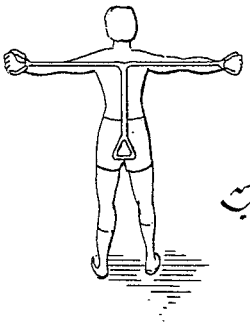

A third loop 12 is integral with the end of the third strap section 11 remote from the joinder section 3. The overall configuration of loop 12 generally corresponds to that of the previously mentioned loops 7 and 10, which will become apparent from comparing sectional view of FIG. 7 with that of FIG. 5. However, the third loop 12 is about twice the size of any of loops 7 or 10. The width A (FIG. 1) of the third loop 12 is approximately 20cm. to conveniently accommodate within the third loop 12 two human feet in a side-by-side disposition, as shown in the exercise of FIG. 16.

It will be observed on comapring the cross-section of strap 11 as shown in FIG. 6 with that of FIG. 8, that the cross-sectional area of the third strap section 11 is greater than that of any of said first and second strap sections 1, 2. In the embodiment shown in FIG. 1, the cross-sectional area of the third strap section 11 is about twice the cross-sectional area of strap 1 (FIG. 8). Inasmuch as the cross-sectional area of strap 1 is the same as that of strap 2, it may be said, in general terms, that the cross-sectional area of strap 11 is the sum of cross-sectional area of straps 1 and 2.

It will be appreciated from the above description that with the exerciser of FIG. 1 in use, the three strap sections 1, 2 and 11 provide three different grades of resistance to a stretching force. If the exercising person grabs in his or her hands the loops 7 and 10, a minimum pulling force is required for the exercise due to the relatively small cross-sectional area as shown in FIG. 8. If, on the other hand, the exercising person attempts to pull apart handle loop 7 and handle loop 12, the stretching of the first strap section 11 will be in excess of that in case of exercising with loops 7 and 10, due to a greater resistance of strap 11 to the stretching force. Accordingly, the force required for stretching the exerciser by applying force to loops 12 and 7 will be greater than in the case of using loops 7 and 10. Finally, the third and highest degree of resistance to the stretching force will be achieved if loops 7 and 10 are held in one hand with loop 12 being held with the other hand. In this case, the cross-sectional areas of strap sections 1 and 2, combine to produce generally the same resistance as the cross-section of the single strap 11. The size of loop 12 allows for two feet to be inserted within the loop to broaden the number of different exercises available, as best seen from FIGS. 15–18.

It will thus be appreciated that a simple, inexpensive device is disclosed which, in effect, has the potential of selective adjustment of the force required for pulling apart the handles during the exercise. The product being an integral molded unit, it is relatively inexpensive and thus affordable to an considerable segment of general public.

The embodiment shown in FIGS. 3, 4 and 10 through 14 presents a further improvement of the exercise according to the present invention.

Inasmuch as the general structure of the exerciser corresonds to that of exerciser in FIG. 1, the respective reference numerals also correspond to those used in FIG. 1 but are increased by one hundred. The embodiment of FIG. 3 corresponds to that of FIG. 1 except or a somewhat modified shape of the joinder section 103 which, in FIG. 3, is solid as opposed to the hollow embodiment of FIG. 1. However, the more important change is in that the first strap section 101 is not of the same cross-sectional area as the strap 102, as will be readily conceivable on comparing FIGS. 12 and 13. On the other hand, however, in the embodiment of FIG. 3, the overall cross-sectional area of strap 111 (FIG. 11) presents again the sum of cross-sectional area of straps 101 and 102 (FIGS. 12 and 13).

Accordingly, it can be said in general terms that the cross-sectional area of said first strap section 101 (FIG. 12) is different from that of said second strap section 102 (FIG. 13).

It will be appreciated that this arrangement provide for a still further degree of resistance to the stretching force. The first, least degree of resistance is achieved when pulling apart handle loops 107 and 110. The strap 102 being of smaller cross-sectional area than strap 101, it will, of course, stretch slightly more than the other strap 101. The next higher degree of resistance will be achieved if handle 110 is combined with handle 112. In this case, the strap 102 will become stretched even more, due to a relatively high resistance of strap 111. The next higher degree of resistance is achieved by combining the use of loop 112 and 107. Finally, the force and higher degree of resistance is achieved by grasping in one hand both of loops 107, 110 and, in the other hand the loop 112.

It will thus be appreciated that the apparatus according to FIG. 3 achieves a still further advantage over the embodiment of FIG. 1, even though the overall manufacturing cost is likely to be the same for both of the embodiments.

Those skilled in the art will readily conceive still further embodiments. For instance, the two embodiments shown in the accompanying drawings have the straps 1, 2, 11 or 101, 102, 111 of generally the same length. Obviously, the straps may be of different length. For instance, one can readily conceive that strap 111 may be shortened even to a degree wherein it would form more or less a portion of the joinder section 103. The embodiment shown in the accompanying drawings, however, is deemed to be preferable. Another readily conceivable modification would depart from the preferable principle of the cross-sectional area of 111 being a sum of cross-sectional areas of 101 and 102, respectively. The oval cross-section of the straps is known to be preferable from the standpoint of facilitating the molding operation. However, other kinds of cross-section are also readily conceivable. For instance, the overall structure may be made of a circular cross-section or the like.

The above few examples of departures from the embodiments shown in the accompanying drawings are indicative that there is a high number of further embodiments of the present invention departing to a greater or lesser degree from what has been disclosed, but still falling within the scope of the following claims.

The embodiments of the invention in which an exclusive property or privilege is claimed are defined as follows:

1. An exerciser comprising, in combination:

(a) a first elongated elastic strap section and a second elongated elastic strap section;

(b) said first elongated elastic strap section and said second elongated elastic strap section being of the same length and being molded integrally with a centrally located joinder section such that said first elongated strap section and said second elongated strap section are normally disposed at an acute angle relative to each other and forms a continuous uninterrupted member;

(c) a first handle loop means and a second handle loop means integral with the free ends of said first and second elongated strap sections, respectively, said first and second handle loop means being of identical shape and size relative to each other;

(d) only one unitary, third elastic strap section protruding from and molded with said joinder section and being integral with same, said third strap section being disposed such that it normally forms the leg of one generally uninterrupted unitary Y-shaped configuration whose arms are defined by said first and second elongated strap section, the cross-sectional area of said third strap section being generally equal to the sum of cross-sectional area of said first elongated strap section and of cross-sectional area of said second elongated strap section;

(e) a third loop means integral with the free end of said third strap section remote from said joinder section, said third loop means being about twice the size of any of said first and second handle loop means, the size of the third loop means being in the range sufficient to accommodate within said third loop means at least two human feet of an average size in a side-by-side disposition.

2. An exerciser as claimed in claim 1, wherein the length of the first elongated elastic strap section is generally equal to the length of the second elongated elastic strap section.

3. An exerciser as claimed in claim 2, wherein the length of the third elongated elastic strap section is generally equal to the length of the second elongated elastic strap section.

4. An exerciser comprising, in combination:

(a) a first elongated elastic strap section and a second elongated elastic strap section;

(b) said first elongated strap section and said second elongated elastic strap section being of the same length and being molded integrally with a centrally located joinder section such that said first elongated elastic strap section and said second elongated elastic strap section are normally disposed at an acute angle relative to each other and forming a continuous uninterrupted member;

(c) a first handle loop means and a second handle loop means integral with the free ends of said first and second elongated elastic strap sections, respectively, said first and second hand loop means being of identical shape and size relative to each other, (d) only one unitary, third elastic strap section protruding from and molded with said joinder section and being integral with same, said third strap section being disposed such that it normally forms the leg of one generally uninterrupted unitary Y-shaped configuration whose arms are defined by said first and second elongated strap-section;

(e) a third loop means integral with the free end of said third strap section remote from said joinder section, said third loop means being about twice the size of any of said first and second handle loop means, the size of the third loop means being in the range sufficient to accommodate within said third loop means at least two human feet of an average size in a side-by-side disposition;

(f) the size of the cross-sectional area of said first elongated elastic strap section being different from that of said second elongated elastic strap section, whereby each of said first, second and third strap sections has a different degree of resistance to a stretching force;

(g) the size of the cross-sectional area of said third elastic strap section being generally equal to the sum of the cross-sectional area of said first elongated elastic strap section and of the cross-sectional area of said second elongated elastic strap section.

5. An exerciser as claimed in claim 4, wherein the length of the first elongated elastic strap section is generally equal to the length of the second elongated elastic strap section.

6. An exerciser as claimed in claim 5, wherein the length of the third elongated elastic strap section is generally equal to the length of the second elongated elastic strap section.

* * * * *